US008484808B2

(12) United States Patent
Kageyama et al.

(10) Patent No.: US 8,484,808 B2
(45) Date of Patent: Jul. 16, 2013

(54) CLIP ATTACHMENT STRUCTURE FOR A WRITING INSTRUMENT

(75) Inventors: Hidehei Kageyama, Kawagoe (JP); Tadao Odaka, Kawagoe (JP)

(73) Assignee: Kotobuki & Co., Ltd. (JP)

( * ) Notice: Subject to any disclaimer, the term of this patent is extended or adjusted under 35 U.S.C. 154(b) by 194 days.

(21) Appl. No.: 13/123,442

(22) PCT Filed: Oct. 10, 2008

(86) PCT No.: PCT/JP2008/068496

§ 371 (c)(1),
(2), (4) Date: Apr. 8, 2011

(87) PCT Pub. No.: WO2010/041336

PCT Pub. Date: Apr. 15, 2010

(65) Prior Publication Data

US 2011/0191987 A1 Aug. 11, 2011

(51) Int. Cl.
*B43K 25/00* (2006.01)

(52) U.S. Cl.
USPC ..... 24/11 R; 24/11 P; 24/3.12; 24/3.7; 401/131

(58) Field of Classification Search
None
See application file for complete search history.

(56) References Cited

U.S. PATENT DOCUMENTS

| | | | | |
|---|---|---|---|---|
| 1,824,012 | A * | 9/1931 | Esterow | 24/11 F |
| 1,923,153 | A * | 8/1933 | Lang | 15/432 |
| 2,130,195 | A * | 9/1938 | Rogers | 401/108 |
| 2,276,513 | A * | 3/1942 | Petau | 24/11 F |
| 2,276,891 | A * | 3/1942 | Stenersen | 24/11 F |
| 2,292,683 | A * | 8/1942 | Bauer | 24/11 F |
| 2,502,680 | A * | 4/1950 | Stewart | 177/129 |
| 3,608,154 | A * | 9/1971 | Ira | 4/11 F |
| 4,231,669 | A * | 11/1980 | Rosbiegalle et al. | 401/58 |
| 4,706,341 | A * | 11/1987 | Celaries | 24/11 R |
| 4,926,525 | A * | 5/1990 | Eylers | 24/11 F |

(Continued)

FOREIGN PATENT DOCUMENTS

| | | |
|---|---|---|
| CH | 418 176 | 7/1966 |
| JP | 54-33126 | 3/1979 |
| JP | 56-83080 | 7/1981 |

(Continued)

OTHER PUBLICATIONS

Supplementary European Search Report for European Application No. 08 877 284.3; mailed Jun. 6, 2012; 9 pages.

*Primary Examiner* — Jack W. Lavinder
(74) *Attorney, Agent, or Firm* — Hiscock & Barclay, LLP

(57) ABSTRACT

A clip mounting structure for a writing implement has a shaft tube, a clip mounted at the rear part of the shaft tube, and an insertion member inserted into the rear part of the shaft tube. A clip mounting section to which the rear part of the clip is fitted and aligned is formed at the rear part of the shaft tube. Mounting sections curved in the direction along the inner peripheral surface of the shaft tube are formed at opposite sides of the rear part of the clip. Fitting recesses into which the mounting sections of the clip are fitted are formed in the outer wall of the insertion member. With the mounting sections of the clip fitted in and engaged with the fitting recesses in the insertion member, the insertion member is inserted into the rear part of the shaft body to fit the rear part of the clip into the clip mounting section of the shaft tube. Thus, the insertion member is engaged in position inside the shaft tube.

4 Claims, 10 Drawing Sheets

U.S. PATENT DOCUMENTS

| | | | | |
|---|---|---|---|---|
| 5,427,464 | A * | 6/1995 | Nakagawa | 401/202 |
| 5,570,965 | A * | 11/1996 | Coolen | 401/98 |
| 6,453,516 | B1 * | 9/2002 | Kageyama | 24/11 HC |
| 7,527,448 | B2 * | 5/2009 | Ono et al. | 401/131 |

FOREIGN PATENT DOCUMENTS

| | | |
|---|---|---|
| JP | 57-22989 | 2/1982 |
| JP | 58-145787 | 9/1983 |
| JP | 59-46288 | 3/1984 |
| JP | 63-53794 | 4/1988 |
| JP | 4-96395 | 8/1992 |
| JP | 5-86573 | 11/1993 |
| JP | 08-072481 | 3/1996 |
| JP | 2008-194927 | 8/2008 |

* cited by examiner

CLIP ATTACHMENT STRUCTURE FOR A WRITING INSTRUMENT

CROSS REFERENCE TO RELATED APPLICATIONS

Pursuant to 35 USC §371, this application is a National Stage of International Application No. PCT/JP2008/068496, filed Oct. 10, 2008, wherein the entire contents of the above-noted document is herein incorporated by reference.

FIELD OF THE INVENTION

The present invention relates to a clip attachment structure for a ballpoint pen, a mechanical pencil, or a writing instrument comprising a plurality of ballpoint pens or mechanical pencils.

BACKGROUND OF THE INVENTION

A conventional clip attachment structure for a writing instrument is known, in which the back end side of a clip is attached and fixed to the back end side of a shaft tube by a tail crown such that only the clip is exposed outside of the shaft tube in terms of aesthetics (see, for example, JP Patent Application Publication 2008-194927).

With regard to the specific construction of a clip attachment structure for a writing instrument described in JP Patent Application Publication 2008-194927 by the applicant, a notch for fitting a base of a clip therein is formed at the back end of a shaft tube, and a window-shaped opening that opens in front of the notch (hereinafter referred to as a middle opening) is provided at a middle part of the shaft tube. In the clip to be attached to the shaft tube, hook-like engaging pieces are formed on both sides of the back end of the clip and on both sides near a middle part of the clip, i.e., at a total of four locations. When the clip is attached, the engaging pieces near the middle part of the clip catch on and engage the front end edge of the middle opening of the shaft tube, and at the same time the engaging pieces at the back end of the clip catch on and engage a notch edge of the notch at the back end of the shaft tube. While in this state, an insertion part of a tail crown is inserted into the back end of the shaft tube, and an engagement recess formed in the insertion part engages an engagement protrusion formed near the notch of the shaft tube, thereby achieving a construction in which the back end of the clip is sandwiched and fixed between a collar (flange) formed at the back end of the tail crown and the notch of the shaft tube.

According to such a clip attachment structure for the writing instrument of the above-noted patent document, the advantage is that the base of the clip may be rigidly attached to the shaft tube with a relatively easy operation, and only the clip is exposed outside of the shaft tube to achieve aesthetics.

SUMMARY OF THE INVENTION

In the clip attachment structure for the writing instrument of the above-noted patent document, since a notch at the back end and a middle opening must be formed on the shaft tube for attaching the clip to the shaft tube, there has been a problem of a high processing cost for the shaft tube. Also, since engaging pieces must be formed in the clip at four locations as described above, there has been a problem of a high processing cost for the clip. Further, there is a difficulty in simultaneously fitting the engaging pieces of the clip at four locations in the notch edge of the notch of the shaft tube and the front end opening edge of the middle opening into engagement, and thus there has been a problem of bad workability in the clip attachment. In addition, if the engaging pieces of the clip at four locations engage the edges of the notch of the shaft tube and middle opening as described above, the portion of the clip that can grasp, for example, a pocket is shortened. Thus, there has been a problem of lack of convenience.

That is, when the clip grasps the pocket, the engaging pieces of the clip near the middle part (which engage the opening edge of the middle opening) act as a fulcrum, and thus the grasping portion of the clip is axially shortened. Therefore, there has been a problem that the clip grasping the pocket tends to be disengaged.

This invention was made to solve the above problems, and is intended to provide a clip attachment structure for a writing instrument, wherein only the back part of a clip may be easily and rigidly attached to the back part of a shaft tube, and the construction of the shaft tube and clip may be simplified to reduce their processing cost.

Further, this invention is intended to provide a clip attachment structure for a writing instrument, wherein a grasping portion of a clip may be longer than the clip of JP Patent Application Publication 2008-194927 even if the length of the clip is equal to that of the clip of the above-noted patent document.

In accordance with the present invention, there is provided a clip attachment structure for a writing instrument comprising a clip having a clip piece, a base formed at a back end of the clip piece, and attachment pieces curving in a direction along an inner circumferential surface of the shaft tube, and an insertion member adapted to be inserted in a back part of the shaft tube for attaching the clip with respect to the back part of the shaft tube, wherein the clip attachment structure comprises fitting recesses formed on an outer wall of the insertion member, necks provided on both sides of the base, the attachment pieces being continuously formed at tips of the necks and adapted to be fitted and engaged in the fitting recesses, and slits formed in an axially parallel fashion in the back part of the shaft tube, so that the insertion member which has the clip with the attachment pieces being fitted and engaged in the recesses can be inserted into the back part of the shaft tube while causing the necks to be fitted into the slits, whereby the clip is securely attached with respect to the back part of the shaft tube.

The clip attachment structure may include a notch formed at the back part of the shaft tube for receiving the base of the clip therein.

One of an inner wall of the shaft tube and the outer wall of the insertion member may have an engaging stopper portion, and the other of the inner wall of the shaft tube and the outer wall of the insertion member may have an engaging protrusion, the engaging protrusion being adapted to be abutted against the engaging stopper portion when the insertion member is inserted into the back part of the shaft tube, whereby the engaging stopper portion and the engaging protrusion collectively function as a means for engaging the insertion member within the shaft tube.

The insertion member may include a collar formed at the back part of the insertion member and adapted to be abutted against a back end of the shaft tube when the insertion member is inserted in the back part of the shaft tube, the engaging protrusion being adapted to be engaged with the engaging stopper portion when the collar abuts the back end of the shaft tube.

According to the invention, by a simple operation that involves insertion of the insertion member into the back part of the shaft tube while the attachment pieces on both sides of the back part of the clip fit in and engage the fitting recesses formed on the outer wall of the insertion member inserted into the back part of the shaft tube, the back part of the clip may be easily attached to the back part of the shaft tube, and in the attached state, the independent movement of the attachment pieces of the clip fitted in the fitting recesses of the insertion member is regulated so as to make sure of the sufficient attachment strength of the clip. The clip attachment part only needs to be formed at the back part of the shaft tube such that the back part of the clip is fitted in and aligned with the clip attachment part, and thus the middle opening of the shaft tube such as found in the above-referenced patent document may be eliminated, thereby facilitating the shaft tube processing to enable the processing cost reduction. Further, for the clip, the attachment pieces only need to be formed in a curved manner at the back part of the clip, thereby also facilitating the clip processing to enable the processing cost reduction.

According to the invention, a notch only needs to be formed at the back part of the shaft tube as the clip attachment part of the shaft tube. The notch may be covered by the clip on the outside of the shaft tube such that a simple clip attachment structure for a writing instrument may be provided.

Further, according to the invention, parallel slits only need to be formed at the back part of the shaft tube as the clip attachment structure of the shaft tube. The slits may be covered by the clip on the outside of the shaft tube such that a simple clip attachment structure for a writing instrument may be provided.

Moreover, according to the invention, when the insertion member is inserted to a predetermined position within the shaft tube while the attachment pieces of the clip fit in and engage the fitting recesses of the insertion member as described above, the engaging stopper portion or engaging protrusion of the shaft tube and the engaging protrusion or engaging stopper portion of the insertion member engage with each other within the shaft tube, such that the clip may be rigidly attached to the shaft tube.

Additionally, the insertion member is inserted into the shaft tube while the attachment pieces of the clip fit in and engage the fitting recesses of the insertion member to cause the collar of the insertion member to abut the back end of the shaft tube as described above, thereby causing the engaging stopper portion and engaging protrusion to securely engage with each other at a predetermined position.

Since only the attachment pieces of the clip are attached to the back part of the shaft tube by the insertion member as described above, only the back part of the clip becomes a fulcrum when the clip grasps, for example, a pocket. Therefore, the grasping portion of the clip is axially lengthened, such that the clip is not easily disengaged from the pocket, and stability during clip grasping may be obtained.

As above, in the clip attachment structure for the writing instrument according to the invention, slits in which the necks of the attachment pieces on both sides of the back part of the clip are fitted into engagement are only formed in the shaft tube to which the clip is attached. With regard to the insertion member inserted into the back part of the shaft tube, the fitting recesses for fitting the attachment pieces therein into engagement may be formed on the outer wall of the insertion member. Therefore, the construction of the shaft tube and insertion member may be simplified. As such, the processing of the shaft tube and insertion member may be facilitated, enabling the reduction of their processing cost.

Particularly in the present invention, the attachment pieces formed on the clip fit in and engage the fitting recesses of the insertion member such that the insertion member in this state is inserted into and engages the back part of the shaft tube, thereby lengthening the portion that the clip can grasp, for example, a pocket, and enabling practical implementation of writing instruments with improved stability when the clip grasps the pocket.

DETAILED DESCRIPTION

Embodiment 1:

The clip attachment structure for the writing instrument according to a first embodiment of the invention comprises a shaft tube 1; a clip 2 attached to the back end of the shaft tube 1; and an insertion member 3 inserted into the back part of the shaft tube 1 with the back part of the clip 2 mounted thereto; wherein the insertion member 3 attaches and secures the back part of the clip 2 to the back part of the shaft tube 1. Its detailed configuration is described below.

A clip attachment part 10 is formed at the back part of the shaft tube 1. The back part of the clip 2 is fitted in and aligned with the clip attachment part 10.

Figure 3:
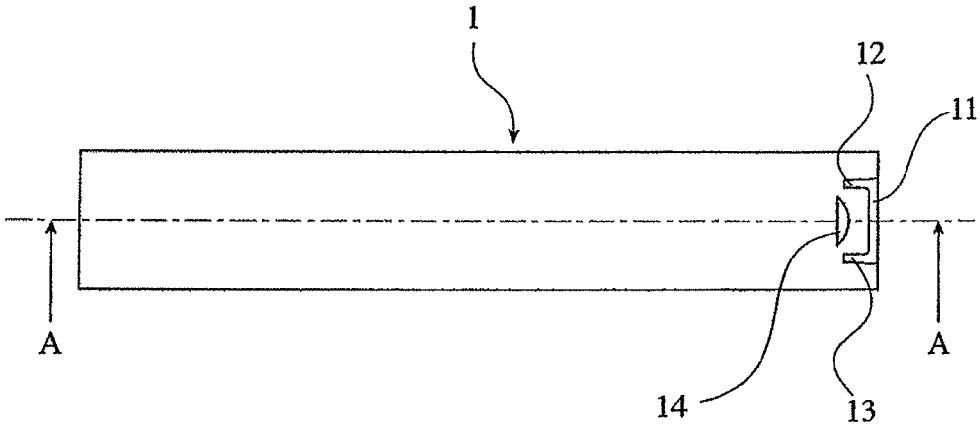
FIG. 3 is a plan view showing the shaft tube of FIG. 1.
Figure 4:
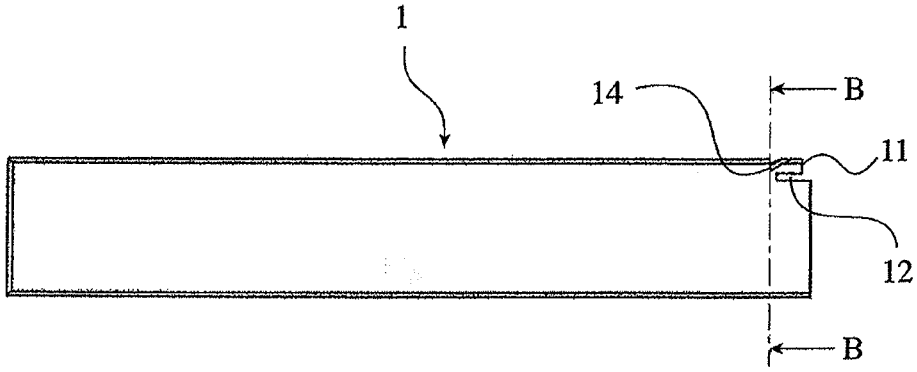
FIG. 4 is a cross-sectional view taken along the line A-A in FIG. 3.
Figure 5:
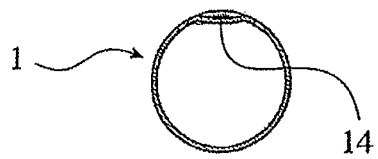
FIG. 5 is a cross-sectional view taken along the line B-B in FIG. 4.

In this embodiment, the clip attachment part 10 comprises a notch 11 (FIG. 3) formed on the back end of the shaft tube 1 for fitting the back end base of the clip 2 therein; slits 12 and 13 formed on both sides of and in front of a notch 11 in a parallel fashion and extending axially; and an engaging stopper portion 14 provided on an inner wall surface of the shaft tube in front of the notch 11 and locking a tail crown 3 at a predetermined position.

Figure 6:
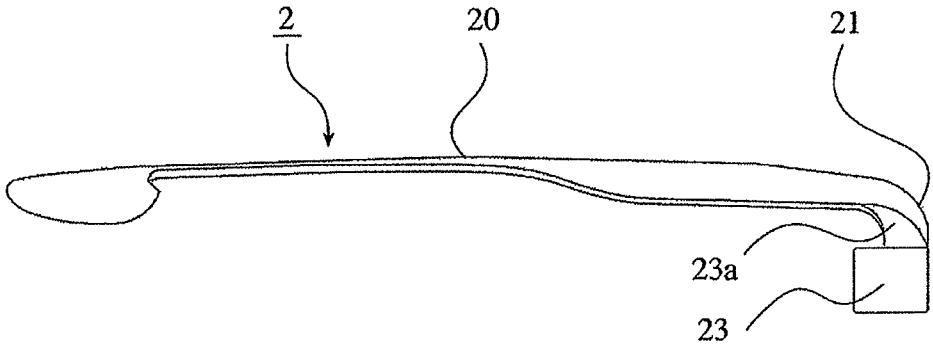
FIG. 6 is a side view of the clip of FIG. 1.
Figure 7:
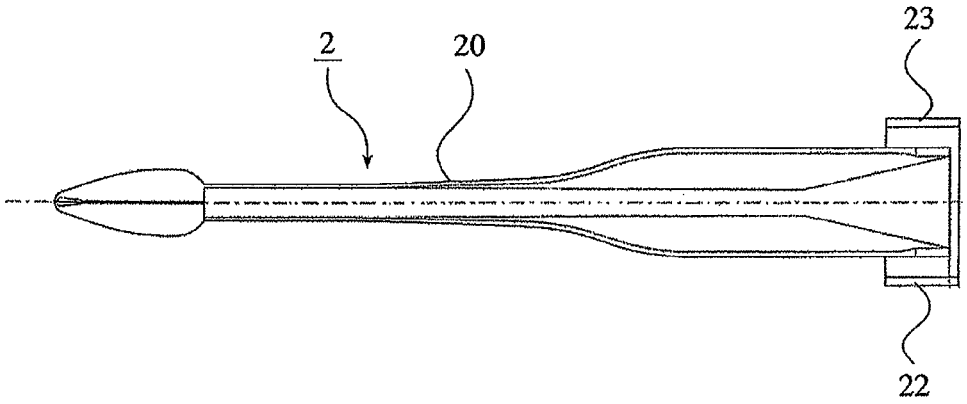
FIG. 7 is a back view of FIG. 6.
Figure 8:
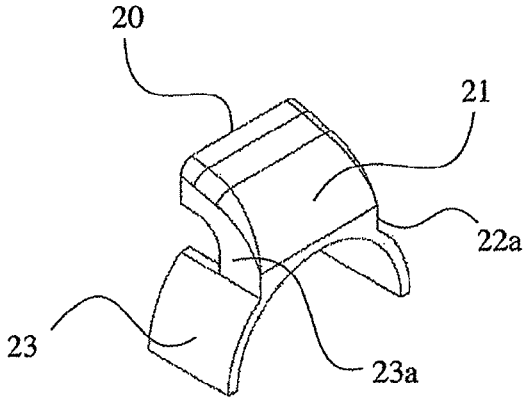
FIG. 8 is a perspective view partially showing the back end portion of the clip of FIG. 6.

The clip 2 comprises a clip piece 20 extending axially along the outer wall surface of the shaft tube 1 from the back end of the shaft tube 1; a curved base 21 formed at the back end of the clip piece 20 in a curved manner; clip legs 22*a* and 23*a* (FIGS. 6 and 8) continuously formed on both sides of the curved base 21 and fitted in the slits 12 and 13 of the shaft tube 1; and attachment pieces 22 and 23 continuously formed at each tip of the clip legs 22*a* and 23*a* with the clip legs 22*a* and 23*a* acting as necks.

The back end faces of the clip legs (necks) 22*a* and 23*a* and attachment pieces 22 and 23 are on the same end plane, and side surfaces of the attachment pieces 22 and 23 are formed into squares that are wider than the width of the clip legs (necks) 22*a* and 23*a*. The attachment pieces 22 and 23 are formed in a curved manner in a direction to cause their lateral surfaces to extend along an inner circumferential surface of the shaft tube 1.

In this embodiment, the insertion member 3 comprises a tail crown inserted into the back part of the shaft tube 1. The tail crown 3 has an insertion part 30 that is inserted into the shaft tube 1. The insertion part 30 comprises a cylindrical barrel (cylindrical body) 31 with its outer diameter being approximately equal to the inner diameter of the shaft tube 1; a pair of right and left arm pieces 32 and 33 formed continuously at the front end of the cylindrical barrel 31 and extending forward; and an annular part 34 extending over tips of the arm pieces 32 and 33 and formed concentrically with the cylindrical barrel 31, wherein an annular collar (flange) 35 formed continuously at the back end of the cylindrical barrel 31 abuts the back end of the shaft tube 1. An outer diameter of the collar 35 is identical to that of the shaft tube 1.

Figure 1:
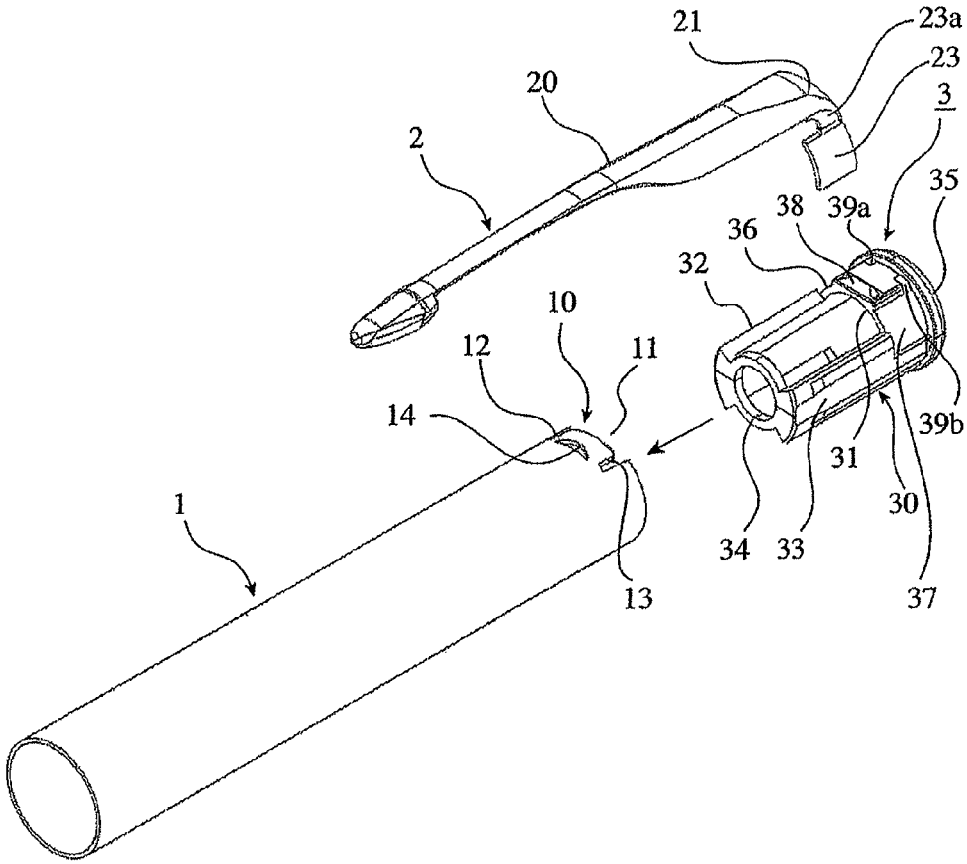
FIG. 1 is an exploded perspective view showing the clip attachment structure for the writing instrument according to a first embodiment of the invention.
Figure 2:
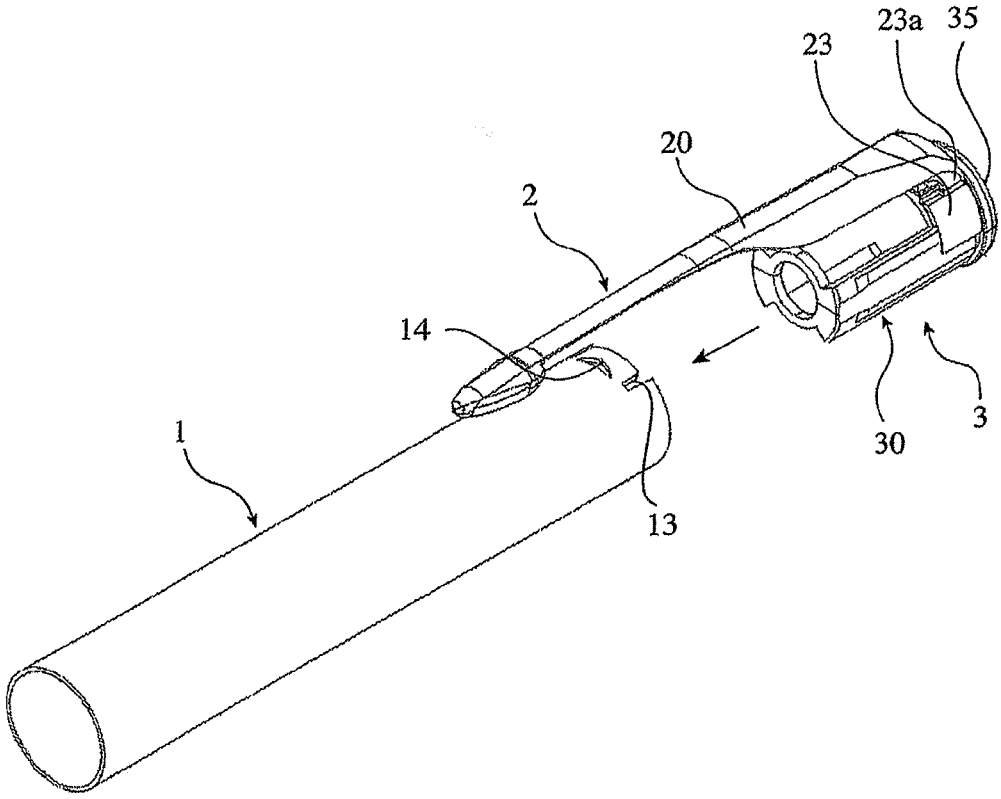
FIG. 2 is a perspective view showing the clip of FIG. 1 attached to the tail crown.
Figure 9:
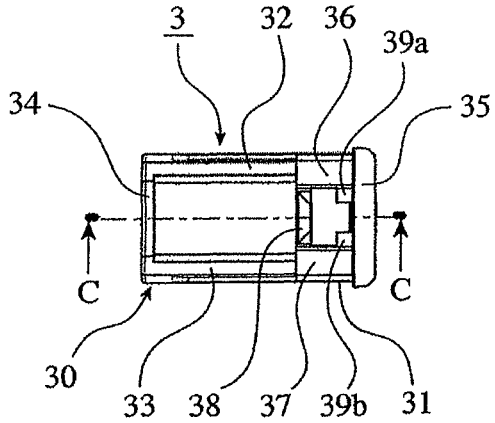
FIG. 9 is a plan view showing the tail crown of FIG. 1.
Figure 10:
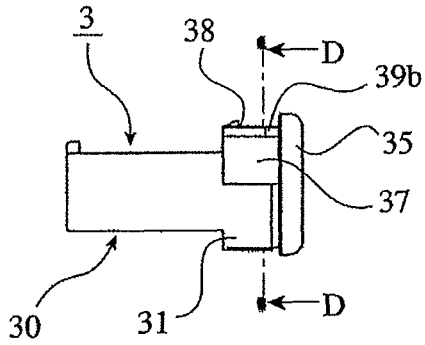
FIG. 10 is a side view of FIG. 9.
Figure 11:
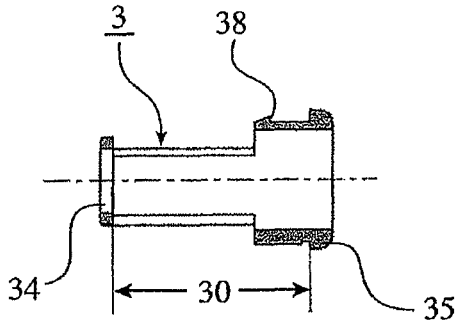
FIG. 11 is a cross-sectional view taken along the line C-C in FIG. 9.
Figure 12:
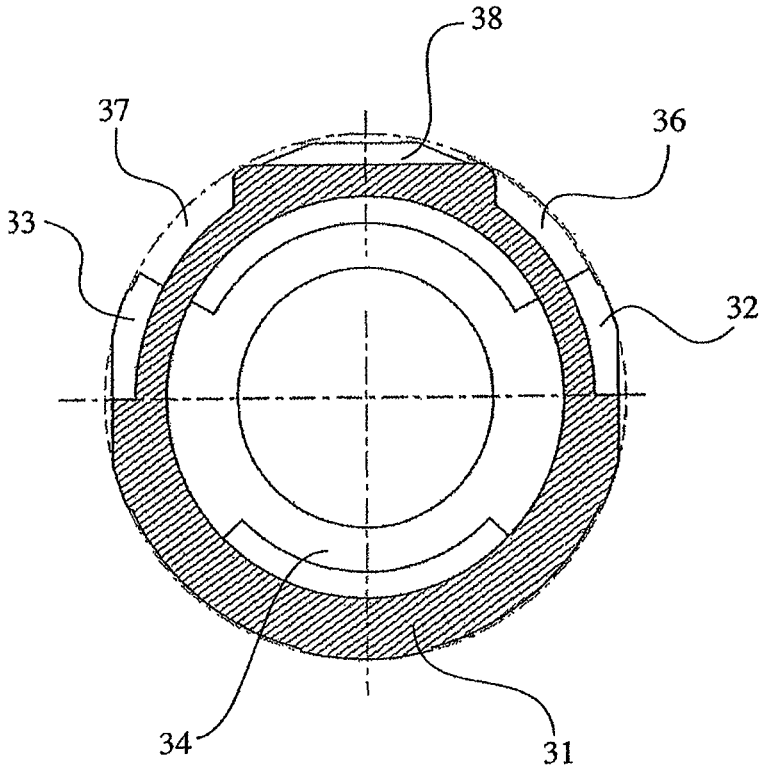
FIG. 12 is an enlarged cross-sectional view taken along the line D-D in FIG. 10.

In such a tail crown 3, fitting recesses 36 and 37 having square side surfaces are formed on the outer wall of the cylindrical barrel 31 (FIGS. 1, 9, and 10). The attachment pieces 22 and 23 of the clip 2 fit in and engage the fitting recesses. Bottom surfaces of these fitting recesses 36 and 37 are formed into curved surfaces having approximately the same curvature as the attachment pieces 22 and 23 of the clip 2. When the attachment pieces 22 and 23 of the clip 2 fit in the fitting recesses 36 and 37, the lateral surfaces of the attachment pieces 22 and 23 and the outer wall of the cylindrical barrel 31 of the tail crown 3 are on the same circumferential surface.

An engaging protrusion 38 is also formed on the outer wall of the cylindrical barrel 31 between the fitting recesses 36 and 37 for engaging the engaging stopper portion 14 of the shaft tube 1.

Notched engaging parts 39*a* and 39*b* are formed on both sides of a junction with the collar 35 in the cylindrical barrel 31. Inner edges of the clip legs (necks) 22*a* and 23*a* at the back end of the clip 2 fit in the notched engaging parts between the fitting recesses 36 and 37.

The attachment of the clip 2 to the shaft tube 1 will now be described.

When attaching the clip 2, first, the attachment pieces 22 and 23 at the back part of the clip 2 fit in and engage the fitting recesses 36 and 37 of the tail crown 3, and the inner edges of the clip legs 22*a* and 23*a* at the back end of the clip 2 fit in the notched engaging parts 39*a* and 39*b* of the tail crown (insertion member) 3. This causes the fitting recesses 36 and 37 of the tail crown 3 and the collar 35 at the back end of the tail crown 3 to regulate the axial movement and circumferential movement of the attachment pieces 22 and 23 of the clip 2. In addition, the lateral surfaces of the attachment pieces 22 and 23 are flush with the outer wall of the cylindrical barrel 31 of the tail crown 3, and the back end base of the clip 2 is maintained in a state in which it is mounted and placed on the cylindrical barrel 31 of the tail crown 3. In this state, the clip legs 22*a* and 23*a* at the back end of the clip 2 form a gap between the cylindrical barrel 31 of the tail crown 3 and the clip piece 20, which enables the cylindrical barrel 31 to be inserted into the back part of the shaft tube 1.

In this way, when the clip legs 22*a* and 23*a* acting as necks at the back end of the clip 2 are pushed into the slits 12 and 13 of the shaft tube 1 while the insertion part 30 of the tail crown 3 on which the back end base of the clip 2 is mounted is inserted into the back part of the shaft tube 1, the curved base 21 at the back end of the clip 2 is fitted in and aligned with the notch 11 at the back end of the shaft tube 1, and the collar 35 of the tail crown 3 abuts the back end of the shaft tube 1 at the point when the entire attachment pieces 22 and 23 at the back end of the clip 2 fitted in and engaging the fitting recesses 36 and 37 of the tail crown 3 are inserted along the inner circumferential surface of the shaft tube 1. At the time of abutment, the engaging stopper portion 14 of the shaft tube 1 engages the engaging protrusion 38 of the tail crown 3 within the shaft tube 1. This causes the clip 2 and the tail crown 3 to be integrally mounted to the back part of the shaft tube 1.

According to the clip attachment structure for the writing instrument described above, by a simple operation in which the attachment pieces 22 and 23 at the back part of the clip 2 fit in and engage the fitting recesses 36 and 37 on the cylindrical barrel 31 of the tail crown (insertion member) 3 to insert the insertion part 30 of the tail crown 3 in this state into the back part of the shaft tube 1 and to cause the back end base (curved base 21) of the clip 2 to be fitted in and aligned with the notch 11 at the back end of the shaft tube 1, the clip 2 may be attached to the back end of the shaft tube 1 with the collar 35 of the tail crown 3 abutting the back end of the shaft tube 1. In the attached state of the clip 2, the attachment pieces 22 and 23 of the clip 2 and the insertion part 30 of the tail crown 3 are contained within the shaft tube 1, and only the clip piece 20 and the collar 35 of the tail crown 3 are exposed outside of the shaft tube 1, thereby achieving aesthetics.

At the position wherein the collar 35 of the tail crown 3 abuts the back end of the shaft tube 1 as described above, the engaging protrusion 38 of the tail crown 3 engages the engaging stopper portion 14 of the shaft tube 1 within the shaft tube 1, thereby causing the back end base of the clip 2 to be rigidly attached to the back part of the shaft tube 1.

Further, when the tail crown 3 is inserted into the back part of the shaft tube 1, by pushing the clip legs (necks) 22*a* and 23*a* into the slits 12 and 13 of the shaft tube 1, the slits 12 and 13 may guide the engaging protrusion 38 of the tail crown 3 in a direction wherein the engaging protrusion 38 engages the engaging stopper portion 14 of the shaft tube 1. This may cause the engaging protrusion 38 to smoothly and securely engage the engaging stopper portion 14.

Furthermore, when the clip 2 attached to the shaft tube 1 grasps, for example, a pocket, only the clip legs 22*a* and 23*a* at the back end of the clip 2 act as a fulcrum such that substantially the entire length of the clip piece 20 functions as a grasping portion of the clip that sandwiches the pocket between the clip 2 and the shaft tube 1. Thus, the clip 2 may not be easily disengaged from the pocket, and the stability during the clip 2 grasps the pocket is improved.

In this specific embodiment, the engaging stopper portion 14 is formed on the inner wall of the shaft tube 1, and the engaging protrusion 38 is formed on the outer wall of the cylindrical barrel 31 of the tail crown 3. The engaging stopper portion and engaging protrusion collectively function as a means for engaging the tail crown (insertion member) 3 within the shaft tube 1. In contrast, the engaging protrusion 38 may be formed on the inner wall of the shaft tube 1, and the engaging stopper portion 14 may be formed on the outer wall of the cylindrical barrel 31 of the tail crown 3, in which case, a similar engagement function may be performed.

Figure 13:
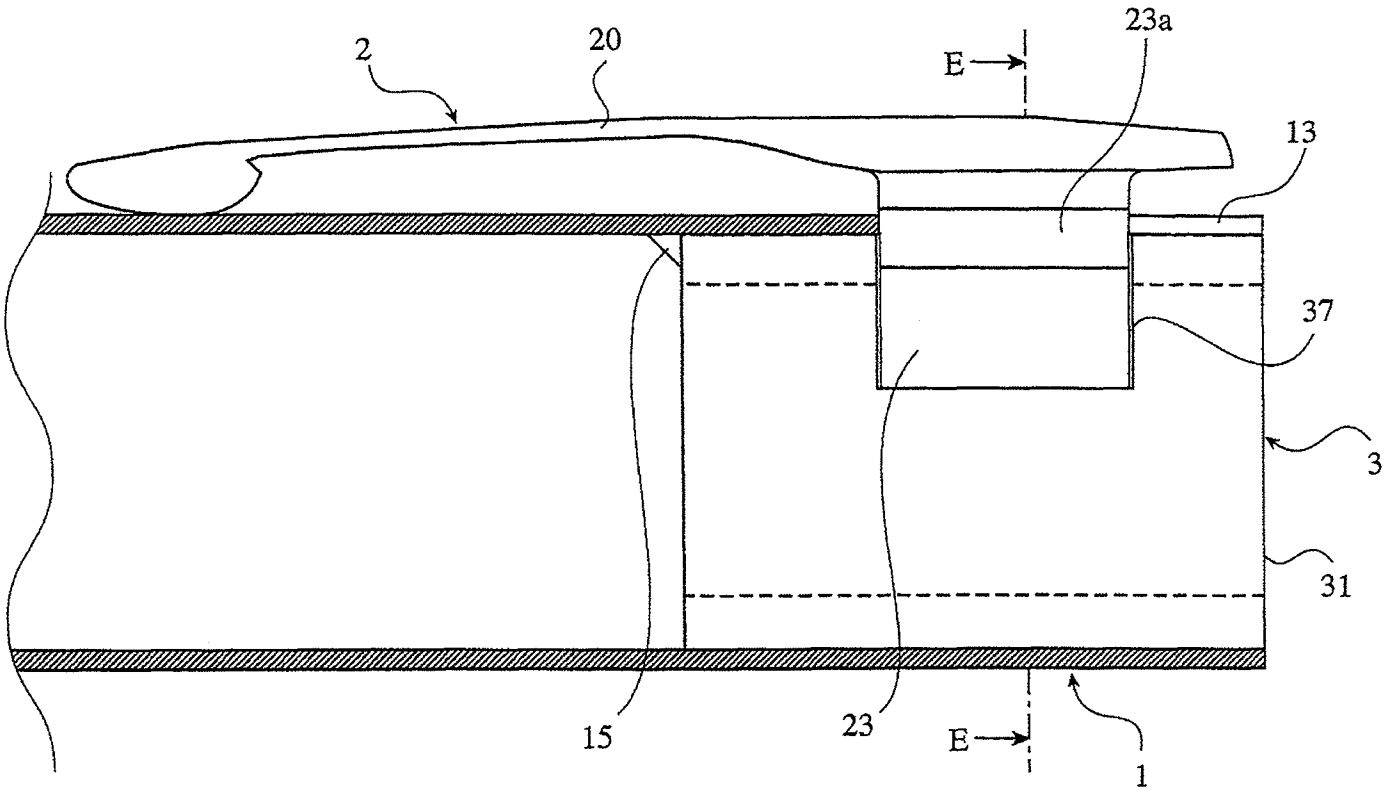
FIG. 13 is a side view showing the clip attachment structure for the writing instrument according to a second embodiment of the invention, with the shaft tube shown in cross section.
Figure 14:
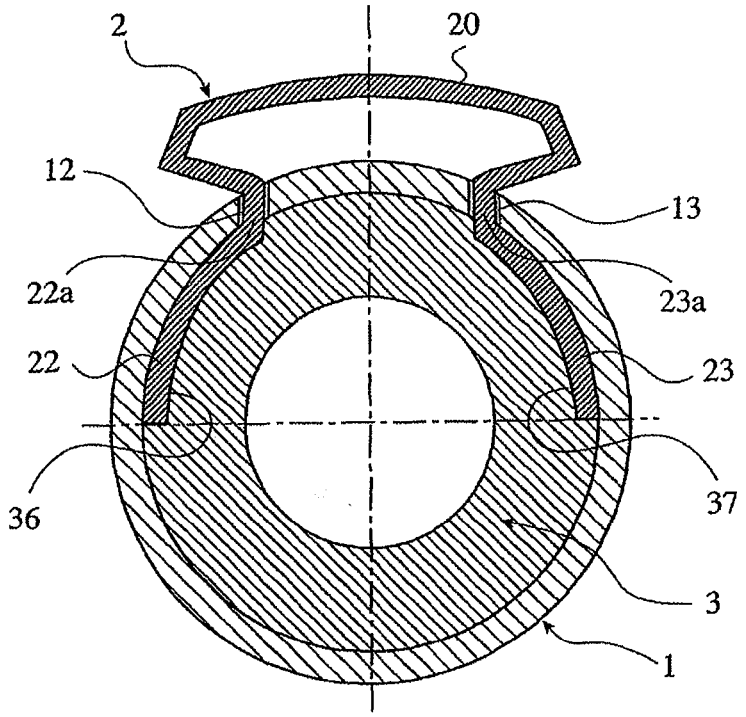
FIG. 14 is a cross-sectional view taken along the line E-E in FIG. 13.
Figure 15:
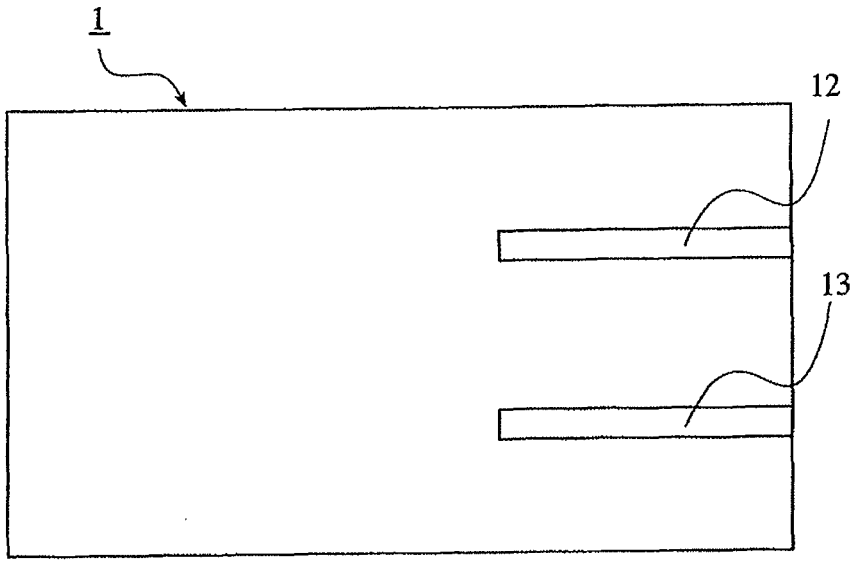
FIG. 15 is a plan view showing the shaft tube of FIG. 13.

Embodiment 2:

In FIGS. 13-15 showing a clip attachment structure for a writing instrument according to a second embodiment, the same numerals are applied to the parts which are identical or correspond to those of FIGS. 1-12 to omit repetition in their description.

In the previous embodiment, the notch 11 is formed at the back end of the shaft tube 1, and the tail crown 3 having the collar 35 at its back end is applied as the insertion member 3. However, in Embodiment 2, the shaft tube 1 eliminating the notch 11 is used, and the cylindrical body 31 is used as the insertion member 3, which is entirely inserted into the back part of the shaft tube 1 with the collar 35 being eliminated.

With regard to the shaft tube 1 of this specific embodiment, the slits 12 and 13 extending axially forward from the back end of the shaft tube 1 are formed for fitting the clip legs (necks) 22*a* and 23*a* of the clip 2 therein. Further, the engaging protrusion 15 engaging the front end of the cylindrical body 31 is provided on the inner wall of the shaft tube 1.

The cylindrical body 31 as the insertion member 3 entirely inserted into the back part of the shaft tube 1 has the outer diameter substantially the same as the inner diameter of the shaft tube 1, and the fitting recesses 36 and 37 are formed at a middle part on the outer wall of the cylindrical body 31.

In this second embodiment, when attaching the clip 2, by fitting the attachment pieces 22 and 23 of the clip 2 in the fitting recesses 36 and 37 of the cylindrical body 31 as in the case of Embodiment 1, the fitting recesses 36 and 37 regulate the axial movement and circumferential movement of the attachment pieces 22 and 23, and the lateral surfaces of the attachment pieces 22 and 23 are flush with the outer wall of the cylindrical body 31, such that the back part of the clip 2 is mounted and temporarily held to the cylindrical body 31. When the cylindrical body 31 in this state is inserted into the back part of the shaft tube 1 and the clip legs 22*a* and 23*a* are fitted in the slits 12 and 13 of the shaft tube 1 to push the entire cylindrical body 31 into the shaft tube 1, the front end of the cylindrical body 31 abuts and engages the engaging protrusion 15 within the shaft tube 1. This causes the entire cylindrical body 31 to be contained within the shaft tube 1 such that the back part of the clip 2 is attached and fixed to the back part of the shaft tube 1.

According to the above-described clip attachment structure for the writing instrument of this second embodiment, the slits 12 and 13 at the back part and the engaging protrusion 15 on the inner wall need only to be formed in the shaft tube 1. Further, with regard to the insertion member 3, the cylindrical body 31 is used, and the fitting recesses 36 and 37 need only to be formed on the outer wall of the cylindrical body 31. Thus, the construction may be simplified, and the processing cost for the shaft tube 1 and insertion member 3 may be further reduced.

Figure 16:
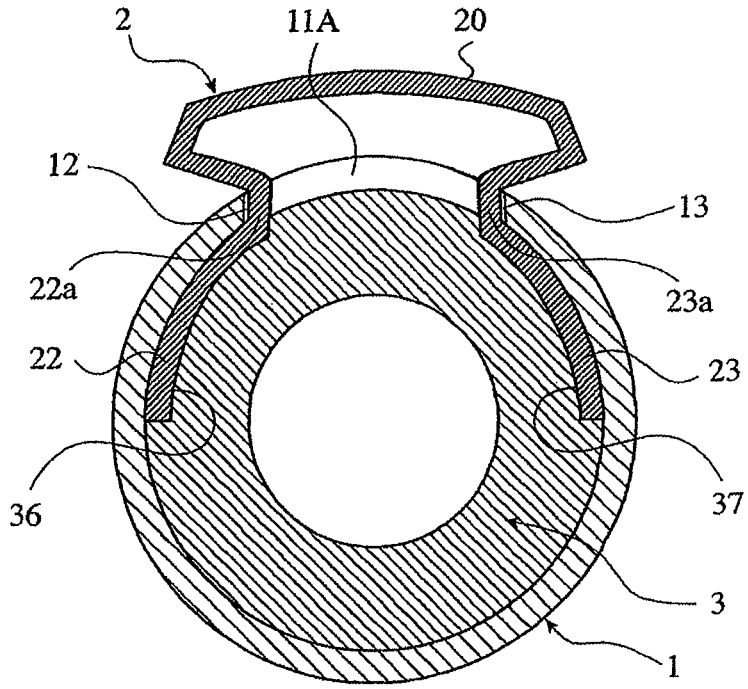
FIG. 16 is a radial cross-sectional view showing the clip attachment structure for the writing instrument according to a third embodiment of the invention.
Figure 17:
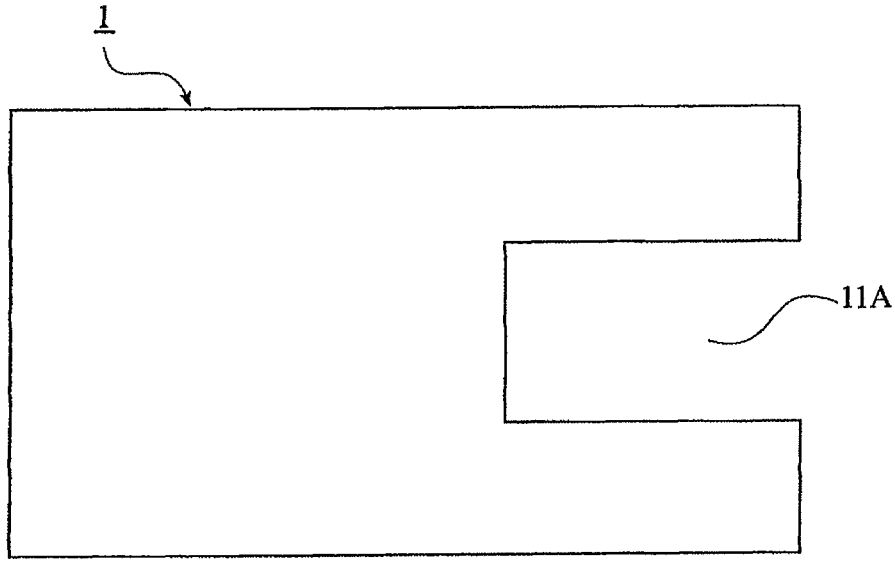
FIG. 17 is a plan view showing a main portion of the shaft tube of FIG. 16.

Embodiment 3:

In a third embodiment, as shown in FIGS. 16 and 17, a planar, recessed and groove-shaped notch 11A is formed as a clip attachment part 10 of the shaft tube 1 at the back part of the shaft tube 1, and the clip legs 22*a* and 23*a* of the clip 2 are fitted together in the notch 11A, such that the lateral surfaces of the clip legs 22*a* and 23*a* abut the inner surface on both sides of the notch 11A.

According to this exemplary embodiment, the planar, recessed and groove-shaped notch 11A needs only to be formed at the back part of the shaft tube 1, and thus the processing cost for the shaft tube 1 may be further reduced.

The invention claimed is:

1. A clip attachment structure for a writing instrument comprising:

a shaft tube;

a clip having a clip piece, a base formed at a back end of the clip piece, and attachment pieces curving in a direction along an inner circumferential surface of the shaft tube, and an insertion member adapted to be inserted in a back part of the shaft tube for attaching the clip with respect to the back part of the shaft tube;

fitting recesses formed on an outer wall of the insertion member;

necks provided on both sides of the base of the clip;

the attachment pieces being continuously formed at tips of the necks and adapted to be fitted and engaged in the fitting recesses; and slits formed in an axially parallel fashion in the back part of the shaft tube, so that the insertion member which has the clip with the attachment pieces being fitted and engaged in the recesses can be inserted into the back part of the shaft tube while causing the necks to be fitted into the slits, whereby the clip is securely attached with respect to the back part of the shaft tube, wherein one of an inner wall of the shaft tube and an outer wall of the insertion member has an engaging stopper portion, and the other of the inner wall of the shaft tube and the outer wall of the insertion member has an engaging protrusion, the engaging protrusion being adapted to be abutted against the engaging stopper portion when the insertion member is inserted in the back part of the shaft tube, whereby the engaging stopper portion and the engaging protrusion collectively function as a means for engaging the insertion member within the shaft tube.

2. The clip attachment structure as recited in claim 1, including a notch formed at the back part of the shaft tube for receiving the base of the clip therein.

3. The clip attachment structure as recited in claim 1, wherein the insertion member includes a collar formed at a back part of the insertion member and adapted to be abutted against a back end of the shaft tube when the insertion member is inserted in the back part of the shaft tube, the engaging protrusion being adapted to be engaged with the engaging stopper portion when the collar abuts the back end of the shaft tube.

4. The clip attachment structure as recited in claim 2, wherein the insertion member includes a collar formed at a back part of the insertion member and adapted to be abutted against a back end of the shaft tube when the insertion member is inserted in the back part of the shaft tube, the engaging protrusion being adapted to be engaged with the engaging stopper portion when the collar abuts the back end of the shaft tube.

* * * * *